United States Patent [19]

Cha et al.

[11] 4,163,475

[45] Aug. 7, 1979

[54] DETERMINING THE LOCUS OF A PROCESSING ZONE IN AN IN SITU OIL SHALE RETORT

[75] Inventors: Chang Y. Cha, Bakersfield, Calif.; William J. Bartel, Grand Junction, Colo.

[73] Assignee: Occidental Oil Shale, Inc., Grand Junction, Colo.

[21] Appl. No.: 898,773

[22] Filed: Apr. 21, 1978

[51] Int. Cl.[2] ..... E21B 43/24; E21B 47/00

[52] U.S. Cl. ..... 166/251; 166/252; 166/259; 299/2

[58] Field of Search ..... 166/251, 252, 250, 256, 166/259, 272, 302, 303

[56] References Cited

U.S. PATENT DOCUMENTS

| | | | |
|---|---|---|---|
| 3,032,102 | 5/1962 | Parker | 166/251 |
| 3,044,543 | 7/1962 | Ramey, Jr. | 166/251 |
| 3,072,184 | 1/1963 | Parker | 166/251 |
| 3,454,365 | 7/1969 | Lumpkin et al. | 166/251 UX |
| 3,661,423 | 5/1972 | Garrett | 299/2 |
| 4,036,299 | 7/1977 | Cha et al. | 166/261 |
| 4,082,145 | 4/1978 | Elkington | 166/251 |

FOREIGN PATENT DOCUMENTS

76/2737 5/1976 South Africa .

OTHER PUBLICATIONS

Rothman, A. J., Lawrence Livermore Laboratory, Quarterly Report, LLL Oil Shale Program, Jul. 30, 1976, UCID-16986-76-2, 35 pp.

Rothman, A. J., Lawrence Livermore Laboratory, LLL Oil Shale Project Quarterly Report, Jan. 25, 1977, UCID-16986-76-4, 35 pp.

*Primary Examiner*—Stephen J. Novosad

*Attorney, Agent, or Firm*—Christie, Parker & Hale

[57] ABSTRACT

A processing zone advances through a fragmented permeable mass of particles containing oil shale in an in situ oil shale retort in a subterranean formation containing oil shale. The fragmented mass has layers of formation particles of differing composition, such as kerogen content, corresponding to strata of differing composition in the formation. The processing zone advances in a direction substantially perpendicular to such layers in the fragmented mass. Kerogen in oil shale is decomposed to produce gaseous and liquid products including shale oil, and shale oil is withdrawn from the retort. At least one characteristic of the shale oil withdrawn from the retort varies in response to differences in composition of such layers of formation particles through which the processing zone advances. Such a characteristic can be a physical property of the shale oil such as viscosity or specific gravity, or a chemical property such as sulfur content or trace metal content. To determine the locus of the processing zone with respect to such layers in the fragmented mass, formation is analyzed for defining the locus of at least one such layer in the fragmented mass before retorting, and shale oil withdrawn from the retort is monitored for variation of such a characteristic corresponding to advancement of the processing zone through such a layer in the fragmented mass.

18 Claims, 4 Drawing Figures

RETORT 4 SHALE OIL, DATE OF PRODUCTION

RETORT 4 SHALE OIL, DATE OF PRODUCTION

DETERMINING THE LOCUS OF A PROCESSING ZONE IN AN IN SITU OIL SHALE RETORT

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale, nor does it contain oil. It is a sedimentary formation comprising marlstone deposit and including dolomite with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as an oxygen-supplying gaseous combustion zone feed to advance the combustion zone through the retort. In the combustion zone, oxygen in the combustion zone feed is depleted by reaction with hot carbonaceous materials to produce heat, combustion gas, and combusted oil shale. Temperatures are attained in the combustion zone sufficiently high to decompose carbonates of alkaline earth metals in oil shale to the corresponding oxides of alkaline earth metals. By the continued introduction of the retort inlet mixture into the retort, the combustion zone is advanced through the fragmented mass in the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas, including carbon dioxide generated in the combustion zone, gaseous products produced in the retorting zone, carbon dioxide from carbonate decomposition, and any gaseous retort inlet mixture that does not take part in the combustion process, is also withdrawn from the bottom of the retort. The products of retorting are referred to herein as liquid and gaseous products.

Residual carbonaceous material in the retorted oil shale can be used as fuel for advancing the combustion zone through the retorted oil shale. When the residual carbonaceous material is heated to its spontaneous ignition temperature, it reacts with oxygen. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

As used herein, the term "processing gas" is used to indicate gas which serves to advance a processing zone, such as a combustion zone, a retorting zone, or both, through the fragmented mass in an in situ oil shale retort, and includes, but is not limited to, an oxygen supplying gas introduced into a retort for advancing a combustion zone and retorting zone through a retort and a hot retorting gas which can be introduced into a retort, such as steam, or which can be generated in a combustion zone in a retort for advancing a retorting zone through a retort.

There are several reasons that it is desirable to know the locus of parts of the combustion and retorting processing zones as they advance through an in situ oil shale retort. One reason is that by knowing the locus of the combustion zone, steps can be taken to control the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason that it can be desirable to monitor the locus of the combustion zone is to provide information so the composition of the combustion zone feed can be varied with variations in the kerogen content of oil shale being retorted. Formation containing oil shale includes horizontal strata or beds of varying kerogen content, including strata containing substantially no kerogen, and strata having a Fischer assay of 80 gallons of shale oil per ton of oil shale. If combustion zone feed containing too high a concentration of oxygen is introduced into a region of the retort containing oil shale having a high kerogen content, oxidation of carbonaceous material in the oil shale can generate so much heat that fusion of the oil shale can result, thereby producing a region of the fragmented mass which cannot be penetrated by retorting gases.

Another reason for monitoring the locus of the combustion and retorting processing zones as they advance through the retort, is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

SUMMARY OF THE INVENTION

The present invention concerns a process for determining the locus of a processing zone, such as a combustion zone or a retorting zone, advancing through a fragmented permeable mass of formation particles in an in situ oil shale retort in a subterranean formation containing oil shale, the fragmented mass having layers of formation particles of differing composition corresponding to strata of differing composition in the formation. The retort has liquid product passing therefrom. Liquid products including shale oil formed by decomposition of kerogen contained in the formation by advancement of a retorting zone through the fragmented mass, and water is withdrawn from the retort. At least one characteristic of the shale oil withdrawn from the retort varies in response to advancement of such a processing zone through such a layer in the fragmented mass.

The method of the present invention comprises analyzing formation at selected locations in the retort before retorting for defining the locus of at least one such layer in the fragmented mass, and monitoring shale oil withdrawn from the retort for variation of such a characteristic in response to advancement of the processing zone through such a layer in the fragmented mass. Such a characteristic can be a physical characteristic such as viscosity or specific gravity or a chemical characteristic such as sulfur or trace metal content.

By analyzing formation for defining the locus of such a layer of formation particles in an in situ oil shale retort, it is possible to predict an absolute or relative value of such a characteristic of shale oil withdrawn from the retort resulting from advancement of such a processing zone through the layer in the fragmented mass. A measured value of the characteristic can be compared with the corresponding predicted value. Such a comparison can be used to determine the locus of the processing zone advancing through the fragmented mass with respect to the layer of formation particles in the fragmented mass.

DRAWINGS

These and other features, aspects, and advantages of the present invention will become more apparent upon consideration of the following description and claims, and the accompanying drawings, wherein:

DESCRIPTION

Figure 1:
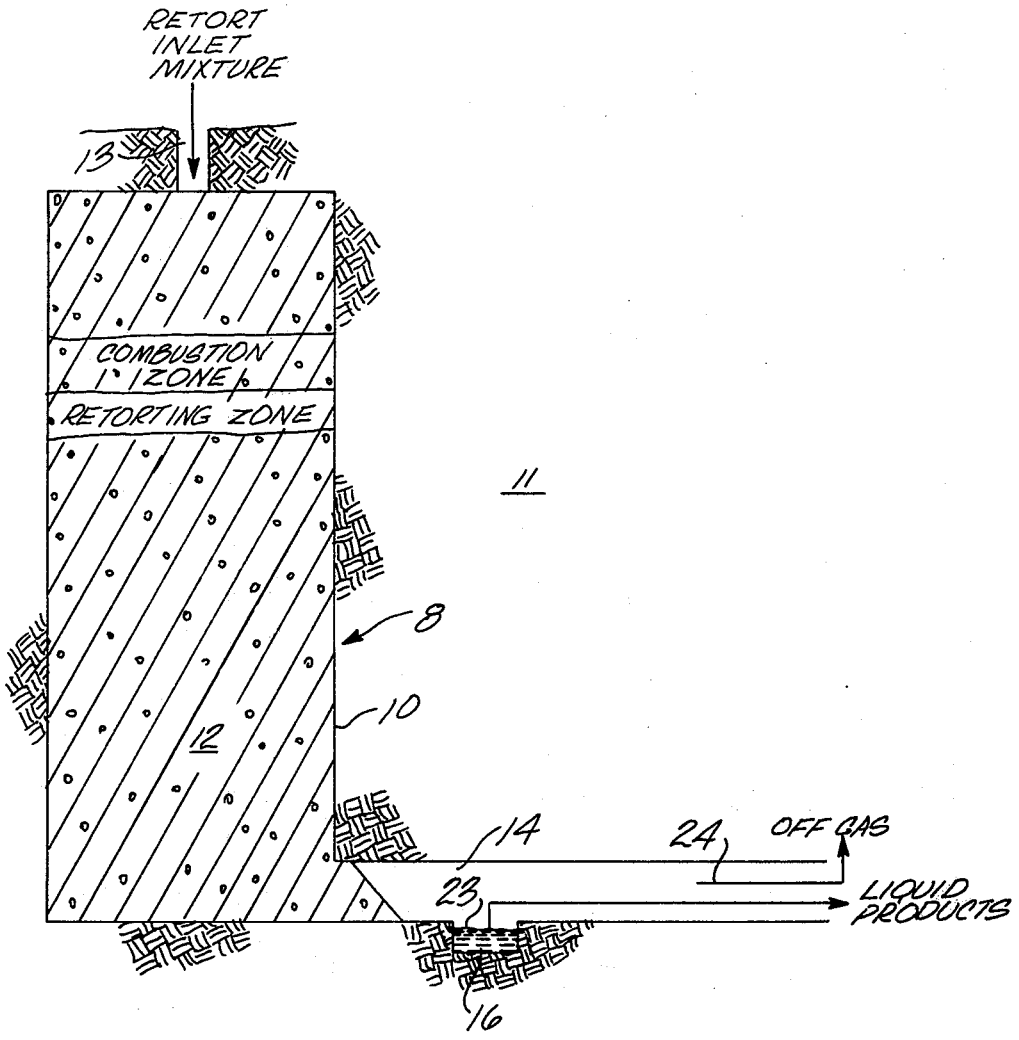
FIG. 1 represents schematically in vertical cross-section an in situ oil shale retort.

Referring to FIG. 1, an in situ oil shale retort 8 is in the form of a cavity 10 formed in an unfragmented subterranean formation 11 containing oil shale. The cavity contains an expanded and fragmented permeable mass 12 of formation particles. The cavity 10 can be created simultaneously with fragmentation of the mass of formation particles 12 by blasting by any of a variety of techniques. Methods for forming an in situ oil shale retort are described in the aforementioned U.S. Pat. Nos. 3,661,423; 4,043,595; 4,043,596; 4,043,597; and 4,043,598.

The fragmented permeable mass in the retort can have a void fraction of from about 10 to about 30%. By void fraction, there is meant the ratio of the volume of voids or spaces between particles in the fragmented mass to the total volume of the fragmented permeable mass of particles in the retort.

One or more conduits 13 communicate with the top of the fragmented mass of formation particles. During the retorting operation of the retort 8, a combustion zone is established in the retort and advanced by introducing a gaseous feed containing an oxygen supplying gas, such as air or air mixed with other gases, into the in situ oil shale retort through the conduits 13. As the gaseous feed is introduced to the retort, oxygen oxidizes carbonaceous material in the oil shale to produce combusted oil shale and combustion gas. Heat from the exothermic oxidation reactions carried by flowing gases advances the combustion zone downwardly through the fragmented mass of particles.

Combustion gas produced in the combustion zone, any unreacted portion of the oxygen supplying gaseous feed, and gases from carbonate decomposition are passed through the fragmented mass of particles on the advancing side of the combustion zone to establish a retorting zone on the advancing side of the combustion zone. Kerogen in the oil shale is retorted in the retorting zone to yield retorted oil shale and liquid and gaseous products, including hydrocarbons.

There is a drift 14, or the like, in communication with the bottom of the retort. The drift contains a sump 16 in which liquid products are collected to be withdrawn for further processing. An off gas containing gaseous products, combustion gas, gases from carbonate decomposition, and any unreacted portion of the gaseous combustion zone feed is also withdrawn from the in situ oil shale retort 8 by way of the drift 14. The off gas can contain large amounts of nitrogen with lesser amounts of hydrogen, carbon monoxide, carbon dioxide, methane and higher hydrocarbons, water vapor, and sulfur compounds, such as hydrogen sulfide. For example, an off gas from an in situ oil shale retort can contain about 30% by volume on a dry basis carbon dioxide.

At the end of retorting operations, at least part of the oil shale in the retort 8 is at an elevated temperature which can be in excess of about 1000° F. The hottest region of the retort is often near the bottom, and a somewhat cooler region is at the top, due to continual cooling by gaseous feed containing oxygen during retorting and conduction of heat to adjacent shale. The oil shale in the retort 8 gradually cools toward ambient temperature when retorting and combustion are complete.

After retorting and combustion operations are completed, the retort contains a fragmented permeable mass of formation particles containing combusted oil shale. As used herein the term "retorted oil shale" refers to oil shale heated to sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. The term "treated oil shale" refers to oil shale treated to remove organic materials and includes retorted and/or combusted oil shale. An individual particle containing oil shale can have a core of retorted oil shale and an outer "shell" of combusted oil shale. Such can occur when oxygen has diffused only part way through the particles during the time it is at an elevated temperature and in contact with an oxygen supplying gas.

Many deposits of oil shale in the western United States are horizontally bedded in strata of differing composition due to the sedimentary nature of oil shale. Layers of formation particles in the fragmented mass correspond to strata in the unfragmented formation because there is little vertical mixing between strata when formation is explosively fragmented. Therefore, samples of various strata through which the retort extends can be taken before initiating retorting of the oil shale and analyses can be conducted for defining the locus of one or more such layers of particles in the fragmented mass. Such samples can be taken from within the fragmented mass, from formation in the retort site before expansion, or from formation near the fragmented mass since little change in composition of a stratum of formation occurs over large areas of formation.

Liquid products withdrawn from the fragmented mass can include a water phase, a shale oil phase, and an emulsion of shale oil and water. In practice of this invention, at least one characteristic of shale oil withdrawn from such a retort is monitored. Such shale oil can be shale oil withdrawn as a separate phase or shale oil separated from such an emulsion of shale oil and water, or mixtures thereof.

By monitoring shale oil for the value of a characteristic of the shale oil which varies in response to differences in composition of such layers in the fragmented mass, it is possible to determine the value of a compositional variable, such as organic sulfur content or Fischer assay, of a layer of formation particles being processed. This is because the absolute or relative value of such a characteristic can be correlated with an absolute or relative value of such a compositional variable of the formation being processed.

To take advantage of such a correlation, formation at selected elevations is analyzed for at least one compositional variable to develop a graph of such a compositional variable as a function of elevation in the fragmented mass. From the graph and the correlation between the value of the characteristic of the shale oil and the value of the compositional variable in the formation the absolute or relative value of the characteristic can be predicted as a function of the elevation of a processing zone in the fragmented mass. For example, a chemical characteristic of the shale oil, the sulfur or trace metal content can be correlated with the sulfur or trace metal content of the oil shale being processed; or a physical characteristic of the shale oil, such as the specific gravity, can be correlated with the kerogen content or Fischer assay of the oil shale.

When it is difficult to make a quantitatively accurate prediction, the relative values of a shale oil characteristic can be predicted by a graphical technique. The shape of a graph, e.g. a curve or histogram, of such a shale oil characteristic plotted as a function of time can be correlated with the shape of a graph of a compositional variable of the formation plotted as a function of elevation in the retort. Maxima and minima of a graph of such a shale oil characteristic can be correlated with maxima and minima of a graph of such a compositional variable, even if the mathematical relationship between correlated maxima and minima is non-linear and has not yet been ascertained. Thus the method of the present invention is flexible and can be practiced in a variety of modes suitable for detailed analysis or for a quick field check of the progress of a retort.

To determine the elevation of a processing zone, such as a retorting zone or a combustion zone, in an in situ oil shale retort, formation is analyzed at selected elevations for the value of at least one compositional variable before processing. Using a correlation between the value of a characteristic of shale oil and the value of the compositional variable of the formation as a function of elevation, the value of the characteristic of shale oil as a function of the elevation of a processing zone in the retort is predicted. The actual value of the shale oil characteristic is measured, and the actual value and the predicted value are compared for determining the elevation of the processing zone in the retort.

The locus of a processing zone advancing through a fragmented permeable mass of formation particles in such an in situ oil shale retort can be determined with respect to layers of formation particles of differing composition in such a fragmented mass by analyzing formation for defining the locus of a plurality of such layers in the fragmented mass including at least one such layer having a localized maximum or minimum in the value of a compositional variable of the formation, and monitoring shale oil withdrawn from the retort for a maximum or minimum in the value of a characteristic of the shale oil corresponding to advancement of the processing zone through such a layer in the fragmented mass. As a maximum or minimum occurs in the plot of measured values of the shale oil characteristic, the maximum or minimum can be correlated with a maximum or minimum on the plot of the composition variable of formation. From that correlation, the locus of a processing zone in the retort as a function of elevation can be determined.

The value of a characteristic of shale oil from an in situ retort as retorting of the fragmented mass progesses can be predicted for each day from startup. This can be done by estimating the rate of advancement of a processing zone through the retort. By predicting the value of such a characteristic of shale oil as a function of the elevation of the processing zone, and by estimating the rate of advancement of the processing zone through the retort, the value of the shale oil characteristic as a function of time from startup can be predicted. By comparing predicted values with measured values as retorting progresses, it is possible to determine if the retorting zone has deviated from its predicted rate of advancement through the fragmented mass.

Not only can the method of this invention be used for determining the elevation of a processing zone such as a retorting zone or a combustion zone in a fragmented permeable mass in a retort, and for detecting deviations from a desired or predicted elevation, but it can also be used for determining the orientation of such a processing zone. If a processing zone is substantially flat and horizontal, it encounters layers of formation particles of differing composition relatively abruptly. Thus, the rate of change in the value of a shale oil characteristic can be associated with a corresponding rate of change in composition of formation. If the processing zone is skewed or significantly warped, it can encounter several layers of particles of differing composition at substantially the same time, thereby tending to obscure the correlation between the value of a shale oil characteristic and the location of the processing zone in the fragmented mass. In essence, the first derivative of the value of the shale oil characteristic as a function of time is reduced when the processing zone is skewed or nonplanar as compared with the first derivative of the value when the processing zone is substantially flat and horizontal. Thus, it is possible to determine if a processing zone is substantially planar and substantially normal to its direction of advancement by comparing the first derivative of a measured value of a shale oil characteristic with the first derivative of a predicted value of the characteristic.

In summary, by monitoring shale oil produced in an in situ oil shale retort for values of at least one characteristic of the shale oil that varies in response to differences in composition of layers of formation particles being processed in the retort, one can determine not only the location or elevation of the processing zone in the retort, but also deviations of the processing zone from its desired shape or orientation. The "locus" of a processing zone includes its location or elevation, its shape, and its orientation.

Any compositional variable of formation containing oil shale that varies as a function of elevation and is associated with variations in a characteristic of shale oil produced in an in situ oil shale retort in such formation can be measured for defining the locus of a processing zone in such a retort in accordance with practice of this invention. Such compositional variables of formation include the content of an element such as sulfur or nitrogen, and of trace elements such as vanadium, iron, nickel, cadmium, lead, silver, molybdenum, selenium, arsenic, fluorine, and the like. The content that is measured can be the total concentration of such an element in a sample of formation before retorting; the concentration of at least one chemical compound including such an element; the concentration of such an element that is organically bound, inorganically bound, or occurs as the free element, in the formation; the content of such an element in shale oil produced in a standard Fischer assay or other retorting test; or a combination of such measurements. The compositional variable can be the organic content of formation such as the kerogen content as determined by the Fischer assay or otherwise, or the content of a particular inorganic compound such as pyrite.

The compositional variable can be a ratio of two such compositional variables in the formation, such as the ratio of arsenic content to sulfur content, the ratio of vanadium content to organically bound nitrogen content, or the ratio of arsenic content to nickel content.

The characteristic of shale oil withdrawn from the in situ retort that is monitored in practice of this invention can be any intensive physical or chemical characteristic which varies in response to differences in composition of layers of formation particles in the retort through which a processing zone advances. Physical characteristics of shale oil that can be monitored include the viscosity, the specific gravity, the boiling point range, the volume percent of fractions of the shale oil as a function of the average boiling point or of the boiling range of the fractions, and the flash point.

Chemical characteristics of shale oil that can be monitored include the content of a chemical species in the oil, such as: the sulfur content; the nitrogen content; the content of trace elements including, for example, arsenic, vanadium, nickel, iron, cadmium, lead, silver, molybdenum, selenium, and fluorine; the content and distribution of n-paraffins; the content of aromatic components; the extent of branching of paraffins in the shale oil; the volume percent of fractions of the oil as a function of the average number of carbon atoms per molecule in such fractions; and the content of a particular kind of organic functional group, such as the mercapto group, the hydroxyl group, the carboxylic acid group, and amino groups. Ratios of such characteristics, such as the ratio of arsenic content to sulfur content, or the ratio of nitrogen content to average molecular weight, can also be monitored.

Any known analytical technique can be used for analyzing formation or shale oil in accordance with this invention, such as colorimetric techniques, gravimetric techniques, liquid-gas chromatography, liquid gel permeation chromotography, standard methods for determining specific gravity and viscosity, and spectrometric techniques such as infrared analysis, ultraviolet analysis, atomic absorption, neutron activation, x-ray analysis, nuclear magnetic resonance spectroscopy, and the like.

Formation can be analyzed in the raw state. Alternatively, samples of formation can be retorted, and retorting products from the samples can be analyzed for at least one shale oil characteristic that can be correlated with a compositional variable of the formation for defining the locus of a layer of formation particles. In an embodiment of this invention, samples of formation are analyzed by subjecting such samples to the standard Fischer assay and measuring a characteristic of the liquid shale oil product thus obtained. In the Fischer assay, a sample customarily weighing 100 grams and representing one foot of core sample is subjected to controlled laboratory analysis involving grinding the sample into small particles and heating the ground sample to produce shale oil. The ground sample is heated in a sealed vessel at a known rate of temperature rise to measure kerogen content, stated in gallons per ton referring to the number of gallons of shale oil recoverable from one ton of oil shale when heated in the same manner as in the Fischer analysis.

The shale oil produced in the Fischer assay is not the same as shale oil produced in an in situ oil shale retort as herein described because the conditions under which the two shale oils are produced are different. Nevertheless, correlations can be made between a characteristic of shale oil from a Fischer assay of a sample of formation and a corresponding characteristic of shale oil produced by in situ retorting of a layer of formation particles corresponding to the sample of formation subjected to the Fischer assay. Such a characteristic of shale oil can be the sulfur content; the nitrogen content; or, preferably, the trace element content of the shale oil from the Fischer assay and of the shale oil produced by in situ retorting, for example, the arsenic content, the vanadium content, the iron content, the nickel content, or the like. Furthermore, the grade of oil shale, for example the oil shale grade as determined by the Fischer assay, can be correlated with an intensive physical property of shale oil from such a grade of oil shale in an in situ oil shale retort. For example, the grade of oil shale can be correlated with the specific gravity of shale oil withdrawn from the retort.

Figure 2:
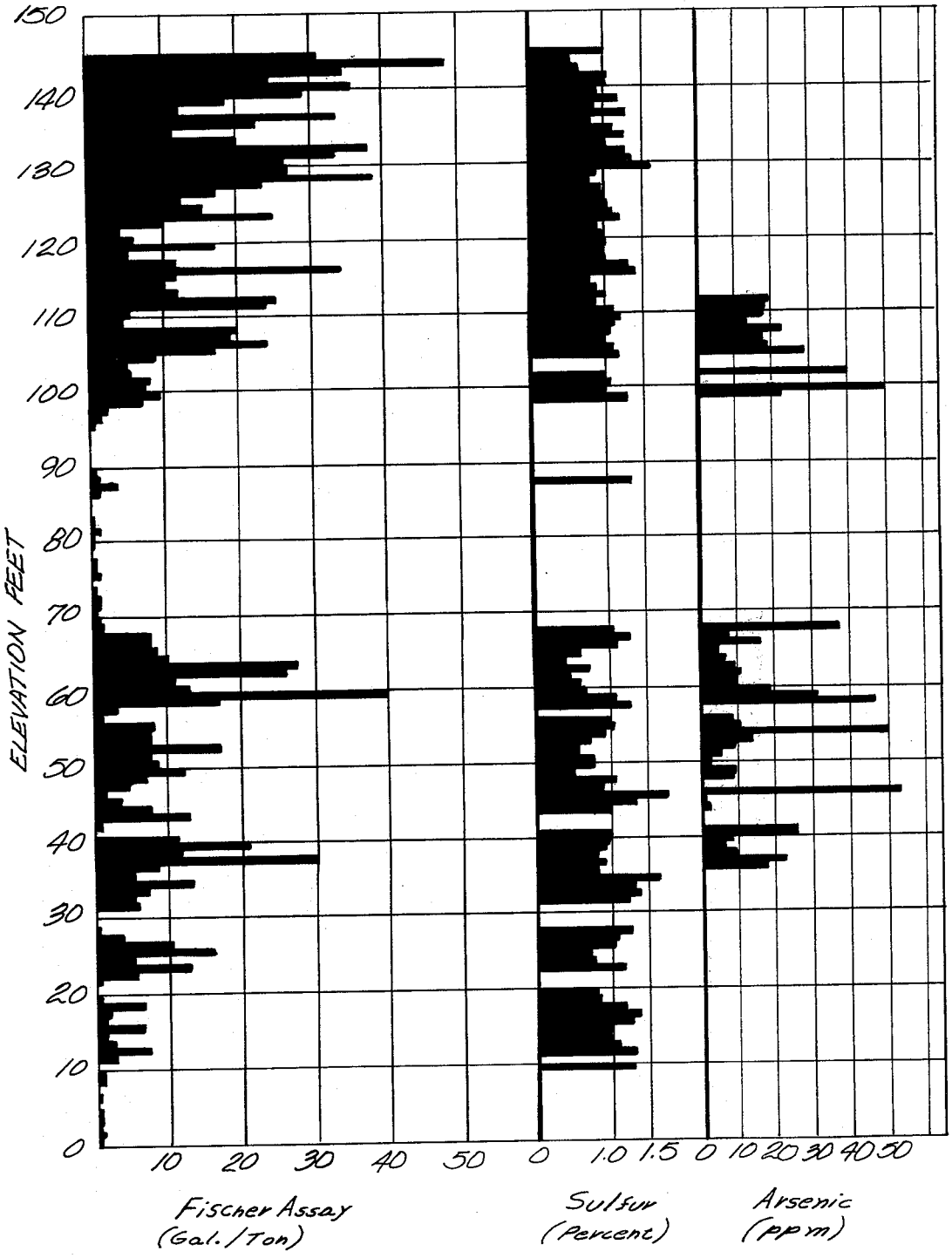
FIG. 2 is a histogram correlating the Fischer assay of a vertical core sample of formation containing oil shale with the sulfur and arsenic contents of shale oil produced by retorting sections of core sample in accordance with the Fischer assay procedure.
Figure 3:
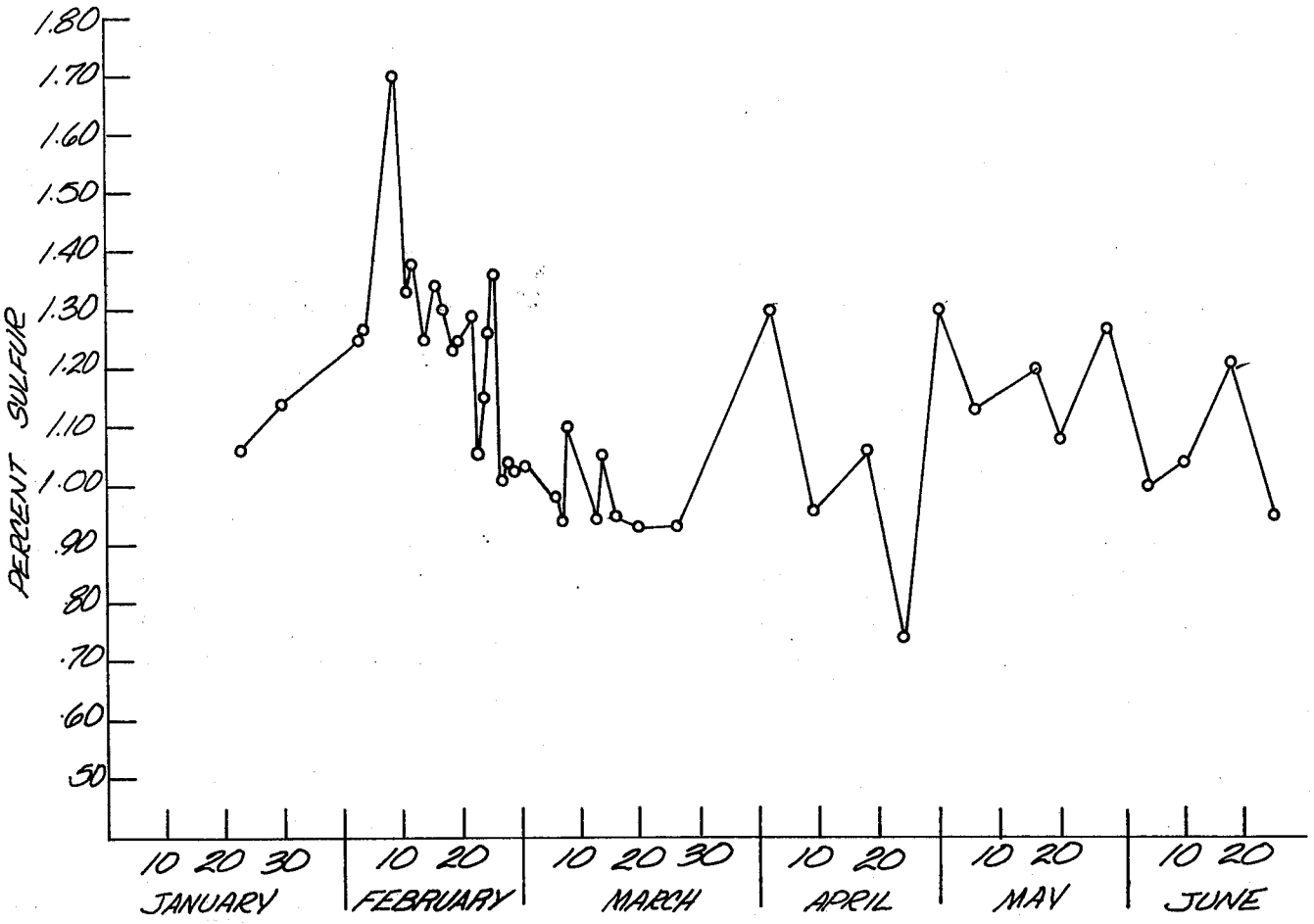
FIG. 3 is a graph of the sulfur content as a function of time of shale oil from an in situ oil shale retort identified as Retort 4.
Figure 4:
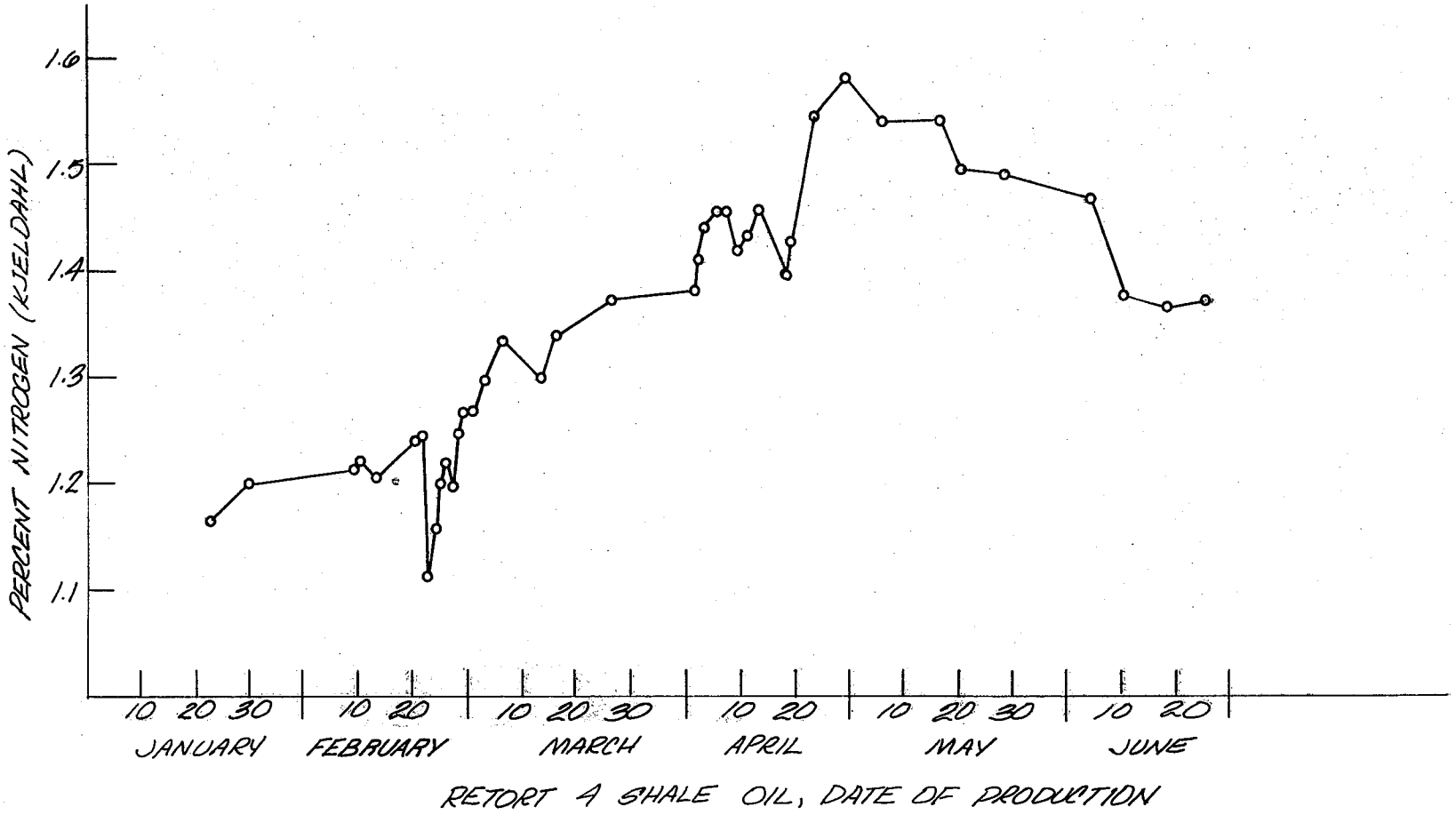
FIG. 4 is a graph of the nitrogen content of shale oil from Retort 4 as a function of time.

Referring to FIG. 2, a histogram of the Fischer assay oil shale grade of a vertical core sample of formation containing oil shale is given as a function of elevation in feet. Correlated with the oil shale grade histogram are partial histograms of the arsenic content and of the sulfur content of shale oil produced in the course of subjecting portions of the core sample to the Fischer assay. To obtain these histograms, a section of core sample was analyzed by the Fischer assay. The shale oil produced from each sample was analyzed for arsenic and for sulfur, and the results were plotted in the form of a histogram of such content as a function of elevation. Arsenic was determined colorimetrically in accordance with UOP method 387-62. Sulfur was determined by a standard method involving burning a sample of shale oil and precipitating sulfur in the resulting combustion gas as barium sulfate.

A comparison of the histograms shows that the sulfur content and especially the arsenic content of the shale oil vary as a function of elevation. Thus, arsenic content or sulfur content, or both, of shale oil produced from such oil shale can be correlated with elevation of a processing zone in an in situ oil shale retort even though no simple correlation is evident between oil shale grade at a particular elevation and the sulfur or arsenic content of shale oil produced from oil shale at such elevation. For example, in the interval of the arsenic histogram extending from the 44 foot to the 47 foot mark, the arsenic content varies from about 1 part per million (ppm) up to 54 ppm back down to 0 ppm, all within a vertical interval of 3 feet. Such wide fluctuations in arsenic content of shale oil can be measured and correlated with elevation in the retort for determining the locus of a processing zone.

Although the liquid and condensible vaporous products from retorting condense upon and trickle through a considerable portion of the fragmented mass, the products do not undergo enough mixing in the fragmented mass to obliterate the correlation between the composition of the layer of particles being retorted and the composition of the shale oil withdrawn from the retort. Vertical mixing of liquid products passing through the fragmented mass occurs to a certain extent, depending in part upon the height of the fragmented mass through which the liquid products pass, and such vertical mixing can limit the precision with which the locus of the processing zone can be determined. Nevertheless, because the rate of advancement of a processing zone in the retort can be slow, on the order of 0.5 to 2 feet per day as described in U.S. Pat. No. 4,036,299 to Cha and Ridley which is incorporated herein by this reference, the variations in shale oil characteristics also occur slowly, and the extent of vertical mixing which occurs is not believed to be sufficient to obscure beyond practical utility the correlation between the locus of the processing zone and the composition of the shale oil withdrawn from the retort.

There is a time delay between retorting of a particular layer of formation particles in an in situ oil shale retort and the appearance at the bottom of the retort of shale oil retorted from that layer. The length of the time delay depends upon the elevation of the retorting zone in the retort. An in situ oil shale retort as described herein can be a few hundred feet high. Shale oil retorted from layers of formation particles high in the fragmented mass in the retort can take days to percolate downwardly through the fragmented mass to the bottom of the retort. As the retorting zone approaches the bottom of the retort, the time delay decreases. In correlating the measurement of a shale oil characteristic with the locus of the retorting zone, this time delay is taken into account. Moreover, some of the shale oil produced initially wets particles in the fragmented mass on the advancing side of the retorting zone and does not appear at the bottom of the retort until later. Once the fragmented mass is wetted, this effect is of less significance.

It can be possible to obtain a good correlation between a characteristic of shale oil produced from a sample of formation and a corresponding characteristic of shale oil produced by in situ retorting when the sample of formation is retorted under conditions approximating as closely as possible the conditions expected to prevail in the in situ retort. Such conditions can include the temperature and rate of heating of formation, the manner of supplying heat for retorting, the extent to which the shale oil from a layer of formation particles contacts particles of unretorted formation before being withdrawn from the retort, and the extent of exposure of shale oil to combustion gases or gaseous products of retorting. Such a correlation can be preferable to one using a standard Fischer assay in some circumstances, such as when an organic structural grouping of the shale oil is a characteristic used in practice of this invention. Generally, however, it is preferred to correlate a characteristic of shale oil produced by in situ retorting with a characteristic of shale oil from a standard Fischer assay. This helps to assure uniformity in testing and provides additional information useful for other purposes.

In another embodiment of the invention, a plurality of in situ oil shale retorts is formed in a subterranean formation containing oil shale, with a sequence of layers of formation particles of differing composition in one retort corresponding to a sequence of layers of formation particles in the other retorts. A processing zone is advanced through one such retort, and the locus of the processing zone is determined by any convenient technique, such as direct temperature measurements in the fragmented mass; addition of tracers in the fragmented mass; the production rate of shale oil as a function of oil shale grade is described in copending U.S. patent application Ser. No. 885,118, filed on 3-10-78 titled Determining the Locus of a Retorting Zone in an Oil Shale Retort by Rate of Shale Oil Production, by Chang Yul Cha and William J. Bartel, which is assigned to the assignee of the present application and incorporated herein by this reference; or the like. A correlation is then made between the measured locus of the processing zone and a characteristic of the shale oil which varies as a function of the locus of the processing zone. Thereafter, when a processing zone is advanced through another of the plurality of retorts, the locus of the processing zone in the retort can be determined by monitoring shale oil withdrawn from the retort for variation of the characteristic.

An advantage of monitoring shale oil for variation of an intensive characteristic of the shale oil to determine the locus of a processing zone is that such a characteristic of shale oil can be measured accurately and quickly by taking one or more small samples of the shale oil coming from the retort. Multiple determinations for improved accuracy are possible and, in addition, many analytical techniques can be adapted conveniently for use in the field.

Characteristics of shale oil can be directly correlated with the locus of a retorting zone because the shale oil is produced in the retorting zone. The method of this invention can also be used to directly or indirectly determine the locus of a combustion zone advancing through the fragmented mass. The locus of the combustion zone can be determined indirectly by estimation from the known locus of the retorting zone. The locus of the combustion zone can be determined directly when a characteristic of the shale oil varies in response to the locus of the combustion zone. Such a characteristic can be the concentration in the shale oil of a constituent which is formed in the combustion zone, travels as a vapor from the cumbustion zone to the retorting zone, and dissolves in or combines with shale oil produced in the retorting zone.

In making predictions and correlations based on concentration of a chemical species, such as a trace element, which originates in the inorganic portion of the oil shale, dilution of the chemical species by shale oil produced from the oil shale must be considered. For example, two layers of particles having the same arsenic content but differing kerogen contents can yield shale oils having differing arsenic concentrations. Similarly, two layers having differing arsenic contents and differing kerogen contents can yield oils having the same arsenic concentration or differing arsenic concentrations depending on the relative distribution of arsenic and kerogen between the two layers.

Although this invention has been described in detail with reference to particular details and embodiments thereof, the particulars of the description are not intended to limit the invention, the scope of which is defined in the appended claims. In the claims, the term "maxima or minima" is intended to include maxima, minima, and both maxima and minima.

What is claimed is:

1. A method for determining the locus of a processing zone advancing through a fragmented permeable mass of particles containing oil shale within the boundaries of an in situ oil shale retort in a subterranean formation containing oil shale, the fragmented mass having layers of formation particles of differing composition corresponding to strata of differing composition in the subterranean formation, kerogen in oil shale in the fragmented mass decomposing to produce gaseous and liquid products including shale oil, the shale oil having at least one characteristic that varies in response to at least one difference in composition of such layers of formation particles through which such a processing zone advances, the method comprising the steps of:

analyzing formation at selected locations in the retort before processing the selected locations for defining the locus of at least one such layer in the fragmented mass;

predicting a variation in at least one characteristic of shale oil from the retort corresponding to advancement of the processing zone through said layer;

withdrawing liquid products including shale oil from the retort;

monitoring shale oil from the retort for observing variation of said characteristic of shale oil; and comparing the observed variation with the predicted variation.

2. A method as recited in claim 1 wherein a physical characteristic of shale oil is monitored.

3. A method as recited in claim 2 wherein the step of analyzing comprises analyzing formation for kerogen content, and the characteristic of shale oil is the specific gravity.

4. A method as recited in claim 1 wherein a chemical characteristic of shale oil is monitored.

5. A method as recited in claim 1 wherein the processing zone is a combustion zone.

6. A method as recited in claim 1 wherein the processing zone is a retorting zone.

7. A method as recited in claim 1 wherein the step of analyzing comprises subjecting formation to a Fischer assay, thereby producing shale oil from such formation, and measuring at least one characteristic of the shale oil so produced.

8. A method for determining the locus of a processing zone advancing through a fragmented permeable mass of particles containing oil shale within the boundaries of an in situ oil shale retort in a subterranean formation containing oil shale, the fragmented mass having layers of formation particles of differing composition corresponding to formation strata of differing composition, the formation including a plurality of such in situ oil shale retorts having mutually corresponding layers of formation particles, the method comprising the steps of:

advancing a processing zone through the fragmented mass in a first such in situ oil shale retort for decomposing kerogen in oil shale in the fragmented mass to produce gaseous and liquid products including shale oil;

withdrawing liquid products including shale oil from the retort;

monitoring shale oil withdrawn from the retort for variations of a characteristic of shale oil that varies in response to the differing composition of such layers through which such a processing zone advances;

correlating observed variations of such a characteristic of shale oil with the locus of the processing zone as a function of elevation in the first retort;

advancing such a processing zone through a fragmented mass in a second such in situ oil shale retort;

monitoring shale oil from the second retort for variations of the characteristic of shale oil; and correlating variations of the characteristic of shale oil from the second retort with variations of the characteristic of shale oil from the first retort.

9. A method as recited in claim 8 wherein the processing zone is a retorting zone.

10. A method as recited in claim 8 wherein the characteristic of shale oil is a physical characteristic.

11. A method as recited in claim 8 wherein the characteristic of shale oil is a chemical characteristic.

12. A method for determining the locus of a processing zone advancing through a fragmented permeable mass of particles containing oil shale in an in situ oil shale retort in a subterranean formation containing oil shale, the subterranean formation including a plurality of generally horizontal strata having differing composition, the method comprising the steps of:

forming a fragmented permeable mass of formation particles containing oil shale in an in situ oil shale retort in the formation, the fragmented mass having generally horizontal layers of particles of differing composition corresponding to such strata in the formation;

analyzing formation at selected elevations for defining the loci of a plurality of such layers in the fragmented mass;

predicting values of at least one characteristic of shale oil from the retort corresponding to advancement of such a processing zone through such layers in the fragmented mass;

establishing a processing zone in the fragmented mass;

introducing a processing gas to an upper portion of the fragmented mass for advancing the processing zone downwardly through the fragmented mass and for retorting oil shale in the fragmented mass to produce gaseous and liquid products including shale oil;

withdrawing shale oil from a lower portion of the retort;

monitoring shale oil withdrawn from the retort for measuring values of such a characteristic; and comparing such measured values of such a characteristic of shale oil from the retort with such predicted values of said characteristic for determining the locus of the processing zone with respect to such layers in the fragmented mass.

13. A method as recited in claim 12 wherein the comparing step comprises comparing the first derivative of such a measured value of said characteristic versus time with the first derivative of such a predicted value of said characteristic versus time.

14. A method for determining the locus of a processing zone advancing downwardly through a fragmented permeable mass of particles containing oil shale in an in situ oil shale retort in a subterranean formation containing oil shale, the subterranean formation including a plurality of generally horizontal strata having differing composition, the method comprising the steps of:

forming a fragmented permeable mass of formation particles containing oil shale in an in situ oil shale retort in the formation, the fragmented mass having generally horizontal layers of particles of differing composition corresponding to such strata in the formation;

analyzing formation at selected elevations for defining the loci of a plurality of such layers in the fragmented mass;

predicting maxima or minima in values of at least one characteristic of shale oil withdrawn from the retort that varies in response to the differing composition of such layers through which such a processing zone advances;

establishing a processing zone in the fragmented mass;

introducing a processing gas to an upper portion of the fragmented mass for advancing the processing zone downwardly through the fragmented mass and for retorting oil shale in the fragmented mass to produce gaseous and liquid products including shale oil;

withdrawing shale oil from a lower portion of the fragmented mass;

monitoring shale oil withdrawn from the fragmented mass for observing maxima or minima in values of said characteristic; and correlating such observed maxima or minima in values of said characteristic of shale oil withdrawn from the retort with such predicted maxima or minima.

15. A method as recited in claim 14 wherein the processing is a retorting zone.

16. A method as recited in claim 14 which comprises the steps of analyzing formation for kerogen content and predicting maxima or minima in values of the specific gravity of shale oil withdrawn from the retort.

17. A method for determining the locus of a processing zone in a fragmented mass in an in situ oil shale retort in a subterranean formation containing oil shale, the formation including a plurality of generally horizontal strata of differing composition, the method comprising the steps of:

determining the value of a compositional variable of such formation at a plurality of elevations in an in situ oil shale retort;

predicting the value of a characteristic of shale oil from the fragmented mass as a function of the value of such a compositional variable of formation at said plurality of elevations in the fragmented mass;

advancing a processing zone through the fragmented mass for decomposing kerogen in oil shale to produce gaseous and liquid products including shale oil;

withdrawing liquid products including shale oil from a lower portion of the fragmented mass;

measuring values of said characteristic of shale oil withdrawn from the fragmented mass; and correlating at least one measured value of the characteristic of shale oil with at least one predicted value of the characteristic of shale oil.

18. A method for determining if a processing zone advancing through a fragmented permeable mass of particles containing oil shale in an in situ oil shale retort in a subterranean formation containing oil shale, the fragmented mass having layers of formation particles of differing composition corresponding to strata of differing composition in the formation, is substantially planar and substantially parallel to said layers, the shale oil having a characteristic that varies in response to advancement of such a processing zone through such a layer in the fragmented mass, the method comprising the steps of:

analyzing formation at selected locations in the retort before processing for defining the locus of at least one such layer in the fragmented mass;

predicting a first derivative of the value of such a characteristic of shale oil versus time for advancement of the processing zone through said layer;

advancing such a processing zone through the fragmented mass for decomposing kerogen in oil shale to produce gaseous and liquid products including shale oil;

withdrawing liquid products including shale oil from the retort;

monitoring shale oil withdrawn from the retort for measuring a value of said characteristic of shale oil for advancement of the processing zone through such a layer;

determining the first derivative of the measured value of said characteristic of shale oil versus time; and comparing such a determined first derivative with such a predicted first derivative.

* * * * *